US008857867B2

(12) United States Patent
Saitou

(10) Patent No.: US 8,857,867 B2
(45) Date of Patent: Oct. 14, 2014

(54) OUTSIDE HANDLE DEVICE FOR VEHICLE DOOR

(75) Inventor: Tadashi Saitou, Miyazaki (JP)

(73) Assignee: Kabushiki Kaisha Honda Lock, Miyazaki (JP)

( * ) Notice: Subject to any disclaimer, the term of this patent is extended or adjusted under 35 U.S.C. 154(b) by 114 days.

(21) Appl. No.: 13/639,383

(22) PCT Filed: Apr. 14, 2011

(86) PCT No.: PCT/JP2011/059237

§ 371 (c)(1),
(2), (4) Date: Oct. 4, 2012

(87) PCT Pub. No.: WO2011/129384

PCT Pub. Date: Oct. 20, 2011

(65) Prior Publication Data

US 2013/0020816 A1 Jan. 24, 2013

(30) Foreign Application Priority Data

Apr. 15, 2010 (JP) ..... 2010-094237

(51) Int. Cl.

| | |
|---|---|
| ***E05B 3/00*** | (2006.01) |
| ***E05B 79/06*** | (2014.01) |
| ***E05B 17/00*** | (2006.01) |
| *E05B 81/76* | (2014.01) |
| *E05B 85/16* | (2014.01) |

(52) U.S. Cl.

CPC ..... *E05B 79/06* (2013.01); *E05B 17/0012* (2013.01); *E05B 81/76* (2013.01); *E05B 85/16* (2013.01); *Y10S 292/53* (2013.01)

USPC ..... 292/336.3; 292/DIG. 53

(58) Field of Classification Search

CPC ..... E05B 17/0012; E05B 79/06; E05B 81/76; E05B 85/16

USPC ..... 292/336.3, DIG. 30, DIG. 53, DIG. 54

See application file for complete search history.

(56) References Cited

U.S. PATENT DOCUMENTS

| | | | | |
|---|---|---|---|---|
| 6,439,626 | B1 * | 8/2002 | Rohlfing | 292/347 |
| 7,226,096 | B2 * | 6/2007 | Ito et al. | 292/336.3 |
| 7,984,937 | B2 | 7/2011 | Tanimoto et al. | |
| 2003/0111850 | A1 | 6/2003 | Kwak | |

FOREIGN PATENT DOCUMENTS

| | | | |
|---|---|---|---|
| CN | 101037907 | A | 9/2007 |
| CN | 201092758 | Y | 7/2008 |

(Continued)

OTHER PUBLICATIONS

Chinese Office Action dated Apr. 1, 2014 issued in the corresponding CN Patent Application 201180019014.2.

*Primary Examiner* — Kristina Fulton
*Assistant Examiner* — Christine M Mills
(74) *Attorney, Agent, or Firm* — Carrier Blackman & Associates, P.C.; William D. Blackman; Joseph P. Carrier

(57) ABSTRACT

An outside handle device for a vehicle door including an outer panel having a latching hole and an insertion hole formed therein for provisionally assembling a handle main body onto the outer panel. The latching hole is engaged with a bolt screwed into one end part of a grip portion. The insertion hole is engaged with a penetrating portion provided on the other end part of the grip portion. A base plate includes a first engagement recess and a second engagement recess so as to open on a side edge of the base plate. The first engagement recess houses the bolt having an enlarged diameter head portion engaged therewith. The second engagement recess houses the penetrating portion so that the other end part of the base plate can engage with the latching groove of the penetrating portion by pivoting the base plate around an axis of the bolt.

8 Claims, 8 Drawing Sheets

(56) References Cited

FOREIGN PATENT DOCUMENTS

| | | | |
|---|---|---|---|
| JP | 2003-027773 | A | 1/2003 |
| JP | 2003-293622 | A | 10/2003 |
| KR | 0163083 | B1 | 3/1999 |

* cited by examiner

OUTSIDE HANDLE DEVICE FOR VEHICLE DOOR

TECHNICAL FIELD

The present invention relates to an outside handle device for a vehicle door, the outside handle device including a handle main body having a grip portion disposed outside an outer panel of the vehicle door, and a base plate fixed to an inner face of the outer panel, the handle main body engaging with the base plate.

BACKGROUND ART

An outside handle device in which a handle assembly including a handle main body having a grip portion is secured, by means of a pair of bolts, to a base member disposed inside an outer panel of a door to thus assemble it onto the door is known from Patent Document 1.

RELATED ART DOCUMENTS

Patent Documents

Patent Document 1: Japanese Patent Application Laid-open No. 2003-27773

SUMMARY OF THE INVENTION

Problems to be Solved by the Invention

Vehicles for which door locked and unlocked states can be switched by electric power have been increasing in recent years, and in such vehicles since it is unnecessary to transmit to the door lock device side an operating force in response to pivoting of a handle main body of an outside handle device, the handle main body may be fixed to the door. If the technique disclosed by Patent Document 1 above is applied to the above structure for fixing the handle main body to the door so as to give a structure in which the handle main body is secured by a pair of bolts to the base member disposed inside the outer panel, since it is necessary to carry out the securing operation using the bolts while supporting by hand the handle main body disposed outside the outer panel so that it does not drop, the assembly operation becomes complicated, and since two bolts are necessary, the number of components and the number of assembly steps increase.

The present invention has been accomplished in light of such circumstances, and it is an object thereof to provide an outside handle device for a vehicle door that makes assembly of a handle main body onto a door easy and can reduce the number of components and the number of assembly steps.

Means for Solving the Problems

In order to attain the above object, according to a first aspect of the present invention, there is provided an outside handle device for a vehicle door, the outside handle device comprising a handle main body having a grip portion disposed outside an outer panel of a vehicle door, and a base plate fixed to an inner face of the outer panel, the handle main body engaging the base plate, characterized in that the outer panel is provided with a latching hole and an insertion hole, the latching hole having inserted therethrough and engaged therewith a first bolt or a second bolt, the first bolt having an enlarged diameter head portion and being screwed into one end part in a longitudinal direction of the grip portion, the second bolt having a base thereof implanted in one end part in the longitudinal direction of the grip portion and having a nut screwed around a tip side thereof, and the insertion hole having inserted therethrough a penetrating portion that is provided on the other end part in the longitudinal direction of the grip portion, penetrates into the outer panel, and has a latching groove provided on the outer periphery thereof, the handle main body being capable of being provisionally assembled onto the outer panel so that the penetrating portion is inserted through the insertion hole while engaging the first bolt or the second bolt with the latching hole, and the base plate is provided with a first engagement recess and a second engagement recess so as to open on a side edge of the base plate, the first engagement recess housing the first bolt or the second bolt so that one end part of the base plate can engage with the enlarged diameter head portion or the nut, and the second engagement recess housing the penetrating portion so that the other end part of the base plate can engage with the latching groove of the penetrating portion by pivoting the base plate having the first bolt or the second bolt housed in the first engagement recess around an axis of the first bolt or the second bolt.

Further, according to a second aspect of the present invention, in addition to the first aspect, the latching hole comprises an insertion hole portion and a latching slit portion, the insertion hole portion enabling the enlarged diameter head portion or the nut to be inserted therethrough, the latching slit portion being connected to the insertion hole portion while enabling a shaft portion of the first bolt or the second bolt to be inserted therethrough but making it impossible for the enlarged diameter head portion or the nut to be inserted therethrough, and in a state in which the latching hole has the first bolt or the second bolt inserted therethrough and engaged therewith and the other end part of the base plate is engaged with the latching groove of the penetrating portion, the direction of opening of the first engagement recess is set so as to be a direction different from the direction of opening of the latching slit portion toward the insertion hole portion.

According to a third aspect of the present invention, in addition to the first or second aspect, the penetrating portion is provided with a through hole that enables a harness connected to an electrical component disposed within the grip portion to be led out.

Furthermore, according to a fourth aspect of the present invention, in addition to any one of the first to third aspect, the base plate is formed into a shape that exhibits resilience between the latching groove of the penetrating portion and the outer panel.

A board 22 of an embodiment corresponds to the electrical component of the present invention.

Effects of the Invention

In accordance with the first aspect of the present invention, the handle main body can be provisionally assembled onto the outer panel by inserting the penetrating portion through the insertion hole while engaging the first bolt or the second bolt on one end side of the grip portion of the handle main body with the latching hole, and in this provisionally assembled state the base plate in a state in which the first bolt or the second bolt is housed in the first engagement recess in one end part of the base plate is pivoted around the axis of the first bolt or the second bolt, thus enabling the other end part of the base plate to be engaged with the latching groove on the outer periphery of the penetrating portion; furthermore, tightening the first bolt or the nut so as to make the enlarged diameter head portion of the first bolt or the nut screwed around the second bolt abut against and be engaged with said one end part of the base plate allows the handle main body to be fixed to the outer panel. Therefore, it is unnecessary to support the handle main body by hand when assembling the handle main body onto the outer panel, it becomes easy to assemble the handle main body onto the vehicle door and, moreover, it is possible to reduce the number of components as well as the number of assembly steps since there is only one position to be secured. Furthermore, since engagement of the base plate with the handle main body is carried out by pivoting around the axis of the first bolt or the second bolt, and the base plate is only moved in parallel to the inner face of the outer panel, it is easy to carry out the pivoting operation of the base plate on the outer panel inner face side, where space is confined.

Furthermore, in accordance with the second aspect of the present invention, since the latching hole is formed from the insertion hole portion, which enables the enlarged diameter head portion or the nut to be inserted therethrough, and the latching slit portion connected to the insertion hole portion, which enables the shaft portion of the first bolt or the second bolt to be inserted therethrough but makes it impossible for the enlarged diameter head portion or the nut to be inserted therethrough, and the direction of opening of the first engagement recess, which is provided in the base plate so as to open on the outer edge thereof, is different from the direction of opening of the latching slit portion toward the insertion hole portion, when one end part of the base plate is engaged with the first bolt or the second bolt in a state in which the shaft portion of the first bolt or the second bolt is inserted through the latching slit portion of the latching hole and the first bolt or the second bolt is inserted through and engaged with the latching hole, the shaft portion of the first bolt or the second bolt does not move from the latching slit portion toward the insertion hole portion side and, moreover, in a state in which said one end part of the base plate is engaged with the first bolt or the second bolt and the other end part of the base plate is engaged with the latching groove on the outer periphery of the penetrating portion, movement of the first bolt or the second bolt becomes impossible, thus making assembly of the handle main body onto the vehicle door easier.

In accordance with the third aspect of the present invention, since the harness connected to the electrical component disposed within the grip portion is led out via the interior of the through hole provided in the penetrating portion, it is possible to prevent the harness from being caught between the handle main body and the outer panel.

Furthermore, in accordance with the fourth aspect of the present invention, since the base plate exhibits resilience between the latching groove and the outer panel in a state in which it is engaged with the latching groove of the penetrating portion, it is possible to prevent rattling of the base plate from occurring in a state in which the handle main body is secured thereto.

EXPLANATION OF REFERENCE NUMERALS AND SYMBOLS

Figure 1:
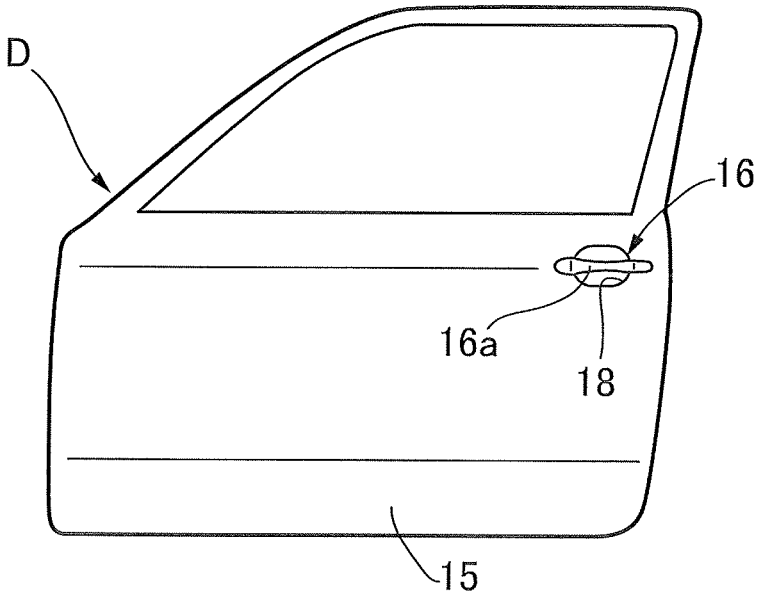
FIG. 1 is a side view of a vehicle door. (first embodiment)

15 Outer panel
16 Handle main body
16*a* Grip portion
17A, 17B, 17C Base plate
20*a* Penetrating portion
22 Board, which is an electrical component
26 First bolt
26*a* Enlarged diameter head portion
26*b* Shaft portion
28 Harness
29 Through hole
32 Latching groove
43A, 43B, 43C First engagement recess
44 Second engagement recess
45 Latching hole
45*a* Insertion hole portion
45*b* Latching slit portion
46 Insertion hole
49 Second bolt
50 Nut
D Vehicle door

MODES FOR CARRYING OUT THE INVENTION

Modes for carrying out the present invention are explained below by reference to the attached drawings.

Embodiment 1

A first mode for carrying out the present invention is explained by reference to FIG. 1 to FIG. 9; first, in FIG. 1, a vehicle door D is switched between locked and unlocked states by electric power, a handle main body 16 having a grip portion 16*a* extending lengthwise in the vehicle fore-and-aft direction and positioned outside an outer panel 15 of the vehicle door D is disposed on the outer panel 15, and this handle main body 16 is fixed to the outer panel 15 by being engaged with a base plate 17A (see FIG. 2) fixed onto an inner face of the outer panel 15. Moreover, the outer panel 15 is provided with an insertion recess 18, into which part of a hand gripping the grip portion 16*a* can be inserted.

Figure 2:
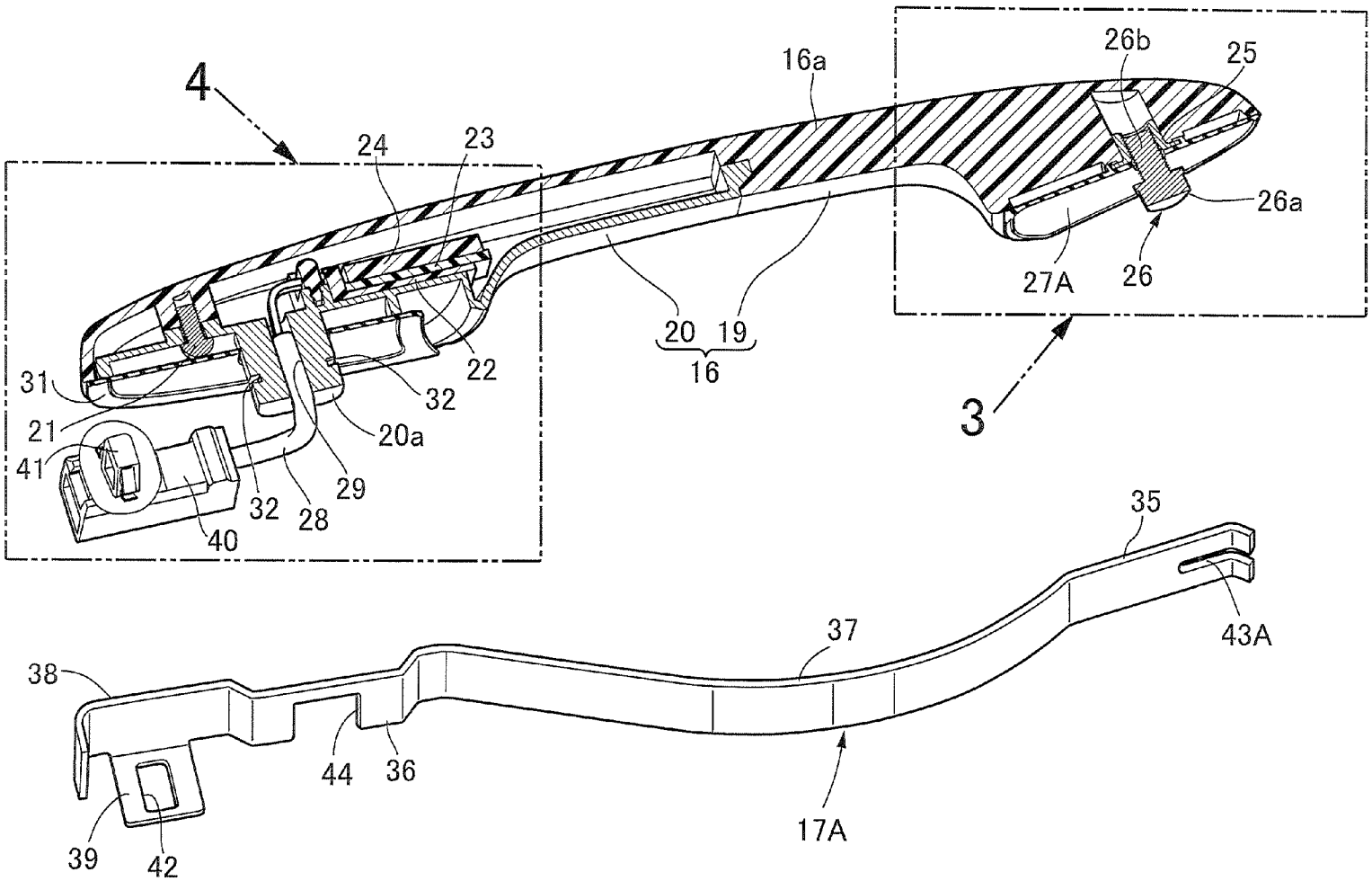
FIG. 2 is a perspective view showing a handle main body in a state in which it is cut away in the middle in the width direction and a base plate, the handle main body being engaged with the base plate, and the two being shown so as to correspond to each other. (first embodiment)

In FIG. 2, the handle main body 16 has a synthetic resin handle base body 19 extending over the entire length of the grip portion 16*a*, and a synthetic resin cover member 20 joined to a reverse face of a rear half of the handle base body 19 by means of a plurality of screw members 21, the grip portion 16*a* being formed from the handle base body 19 and part of the cover member 20. Furthermore, housed between the handle base body 19 and the cover member 20 are a board 22 fixed to an inner face of the cover member 20, a sensor 23 disposed on the board 22 in order to detect a state in which the grip portion 16*a* is gripped by a vehicle user, and an antenna 24 disposed on the board 22 so that the sensor 23 is interposed between the antenna 24 and the board 22.

Figure 3:
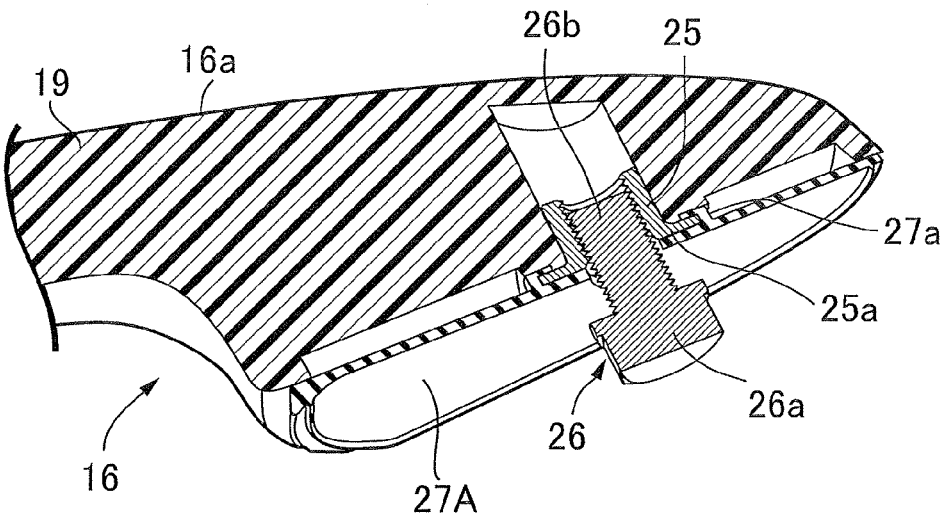
FIG. 3 is an enlarged view shown by arrow 3 in FIG. 2. (first embodiment)

Referring in addition to FIG. 3, press fitted into a face of one end part (front end part in this embodiment) of the grip portion 16*a* that faces the outer panel 15 side is a cylindrical nut 25 having at one end a flange portion 25*a* protruding radially outward, and screwed into this nut 25 is a shaft portion 26*b* of a first bolt 26 having an enlarged diameter head portion 26*a*. Furthermore, a first seal member 27A is fitted onto the face of said one end part of the grip portion 16*a* that faces the outer panel 15 side, the first seal member 27A being formed into a flat plate shape integrally having a cover portion 27*a* covering the flange portion 25*a* of the nut 25 from opposite faces, said one end part of the grip portion 16*a* is abutted against an outer face of the outer panel 15 via the first seal member 27A, and the first bolt 26 is screwed into said one end part of the grip portion 16*a* so as to extend through a middle section of the first seal member 27A and project outward.

Figure 4:
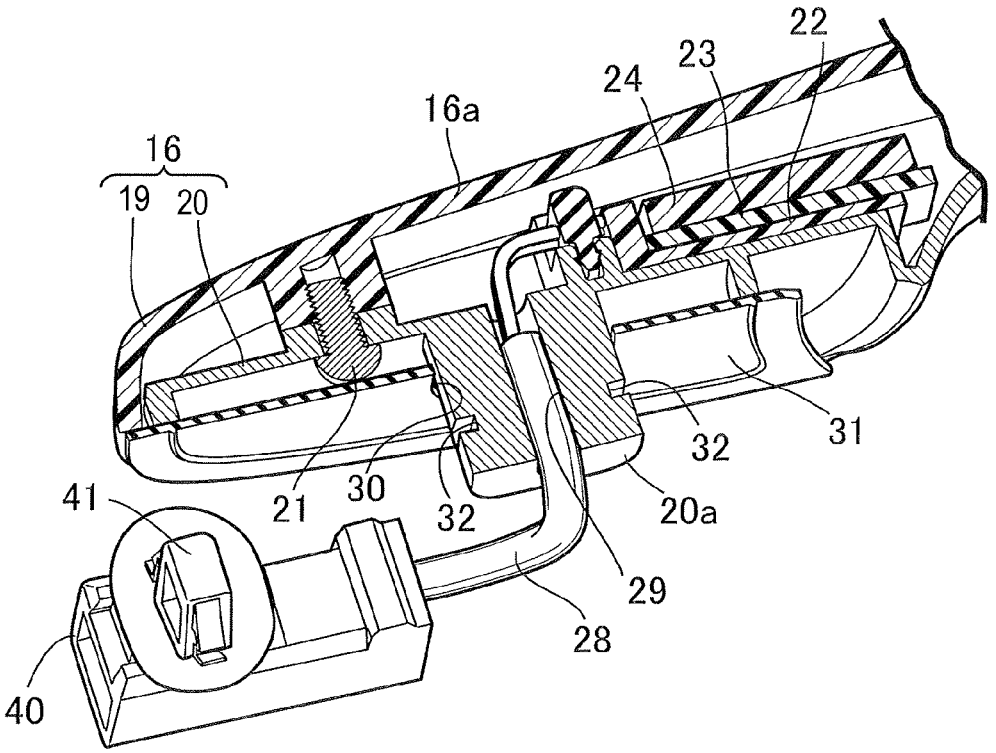
FIG. 4 is an enlarged view shown by arrow 4 in FIG. 2. (first embodiment)

Referring in addition to FIG. 4, the other end part (rear end part in this embodiment) in the longitudinal direction of the grip portion 16*a* is provided with a penetrating portion 20*a* penetrating into the outer panel 15, in this embodiment the penetrating portion 20*a* being provided integrally with the cover member 20 forming part of the grip portion 16*a*. The penetrating portion 20*a* is formed into an angular tube shape having a rectangular cross-sectional shape, and the penetrating portion 20*a* is provided with a through hole 29, a harness 28 connected to the board 22, which is an electrical component disposed within the grip portion 16*a*, being led out via the through hole 29.

Furthermore, a flat plate-shaped second seal member 31 is fitted onto a face of said other end part of the grip portion 16*a* that faces the outer panel 15 side, the second seal member 31 having an opening 30 for the penetrating portion 20*a* to be inserted through, and said other end part of the grip portion 16*a* is abutted against the outer face of the outer panel 15 via the second seal member 31. Moreover, the penetrating portion 20*a* projects from the second seal member 31, and a pair of vertically extending latching grooves 32 and 32 are provided on the outer periphery of a section of the penetrating portion 20*a* that projects from the second seal member 31.

Focusing on FIG. 2, the base plate 17A is formed so as to extend lengthwise in the passenger vehicle fore-and-aft direction so as to correspond the grip portion 16*a* of the handle main body 16 while integrally having a first engagement portion 35 that abuts against an inner face of the outer panel 15 on one end (front end in this embodiment) side of the handle main body 16 and enables the enlarged diameter head portion 26*a* of the first bolt 26 to be engaged therewith, a second engagement portion 36 that abuts against the inner face of the outer panel 15 on the other end (rear end in this embodiment) side of the handle main body 16 and can engage with the outer periphery of the penetrating portion 20*a*, a curved portion 37 that provides a connection between the first and second engagement portions 35 and 36 and protrudes to the side opposite to the outer panel 15, and an abutment plate part 38 that is connected to the second engagement portion 36 on the side opposite to the curved portion 37 and abuts against the inner face of the outer panel 15.

The first engagement portion 35 in one end part of the base plate 17A is formed into a flat plate shape, and a first engagement recess 43A is provided in the first engagement portion 35, the first engagement recess 43A housing the first bolt 26 while enabling the enlarged diameter head portion 26*a* to be engaged with the first engagement portion 35. The second engagement portion 36 in the other end part of the base plate 17A is formed into a trapezoidal shape while projecting toward a side away from the outer panel 15, and a second engagement recess 44 is provided in the second engagement portion 36, the second engagement recess 44 housing the penetrating portion 20*a* while enabling the second engagement portion 36 to be engaged with the latching grooves 32 of the penetrating portion 20*a* by pivoting the base plate 17A around the axis of the first bolt 26 in a state in which the first bolt 26 is housed in the first engagement recess 43A. Furthermore, the abutment plate part 38 is formed into a flat plate shape, and a connector retaining part 39 is provided so as to be connected at right angles to the side edge of a lower part of the abutment plate part 38. Formed in the connector retaining part 39 is a retaining hole 42 for resiliently engaging with and retaining a clip 41 mounted on a connector 40, the harness 28 led out via the through hole 29 of the penetrating portion 20*a* being connected to the connector 40.

The first and second engagement recesses 43A and 44 are provided in the base plate 17A so as to open on the side edge of the base plate 17A, and in this embodiment the first engagement recess 43A is provided on the front edge of a front end part of the first engagement portion 35 so as to open toward the front in the passenger vehicle fore-and-aft direction, and the second engagement recess 44 is provided on the lower edge of the second engagement portion 36 so as to open downward.

Moreover, since the second engagement portion 36 has a trapezoidal shape, in a state in which the second engagement portion 36 is engaged with the latching grooves 32 of the penetrating portion 20*a*, the second engagement portion 36 exhibits resilience between the latching grooves 32 and the outer panel 15.

Figure 5:
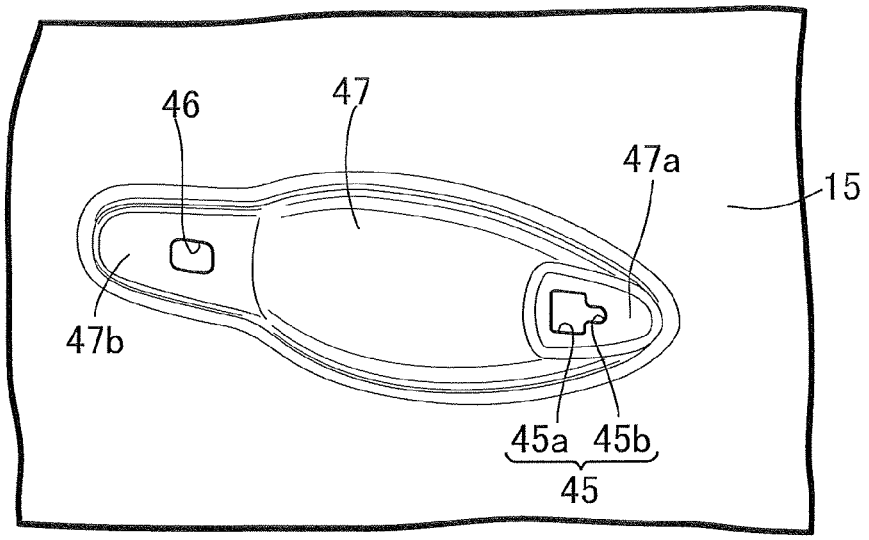
FIG. 5 is a perspective view showing the outer panel inner face side in a state in which the handle main body is not assembled. (first embodiment)

In FIG. 5, the outer panel 15 is provided with a latching hole 45 and an insertion hole 46, the latching hole 45 allowing the first bolt 26 having the enlarged diameter head portion 26*a* and screwed into one end part in the longitudinal direction of the grip portion 16*a* to be inserted therethrough and engaged therewith, and the insertion hole 46 allowing the penetrating portion 20*a* provided on the other end part in the longitudinal direction of the grip portion 16*a* to be inserted therethrough.

The outer panel 15 is also provided with a protruding part 47 protruding inward so as to form the insertion recess 18 provided on the outer face side of the outer panel 15, the latching hole 45 is provided in a first flat portion 47*a* formed on a front part of the protruding part 47 along the vehicle fore-and-aft direction, and the insertion hole 46 is provided in a second flat portion 47*b* formed in a rear part of the protruding part 47 along the fore-and-aft direction. The first engagement portion 35 on one end side of the base plate 17A abuts against the first flat portion 47*a*, and the second engagement portion 36 and the abutment plate part 38 on the other end side of the base plate 17A abut against the second flat portion 47*b*.

The latching hole 45 is formed from an insertion hole portion 45*a* that enables the enlarged diameter head portion 26*a* to be inserted therethrough, and a latching slit portion 45*b* connected to the insertion hole portion 45*a* while enabling the shaft portion 26*b* of the first bolt 26 to be inserted therethrough and making it impossible for the enlarged diameter head portion 26*a* to be inserted therethrough, and is provided in the outer panel 15 so that, in a state in which the penetrating portion 20*a* is inserted through the insertion hole 46, the handle main body 16 can be provisionally assembled onto the outer panel 15 by engagement of the first bolt 26 with the latching hole 45.

Figure 6:
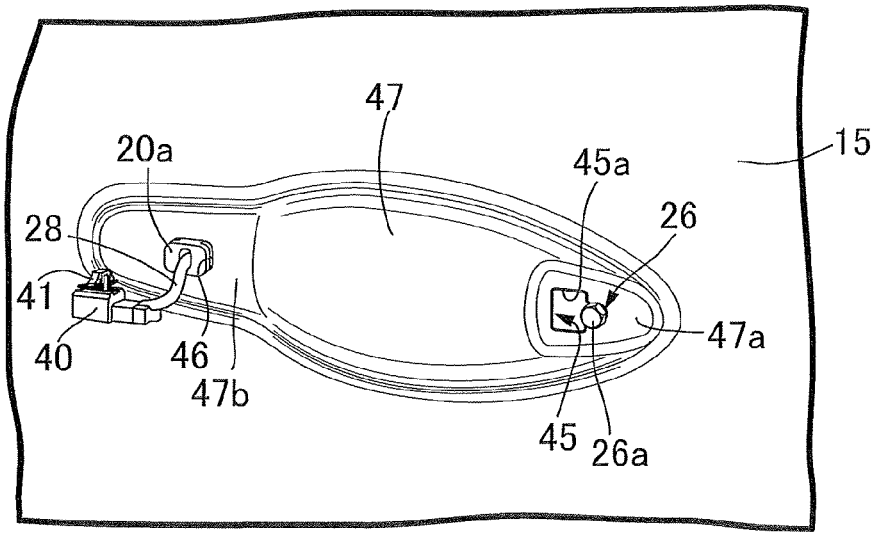
FIG. 6 is a perspective view, corresponding to FIG. 6, in a state in which the handle main body is provisionally assembled. (first embodiment)

As shown in FIG. 6, the penetrating portion 20*a* is inserted through the insertion hole 46 while engaging the first bolt 26 with the latching hole 45 by inserting the enlarged diameter head portion 26*a* through the insertion hole portion 45*a* and them moving the shaft portion 26*b* toward the latching slit portion 45*b* side, thereby enabling the handle main body 16 to be provisionally assembled onto the outer panel 15.

Figure 7:
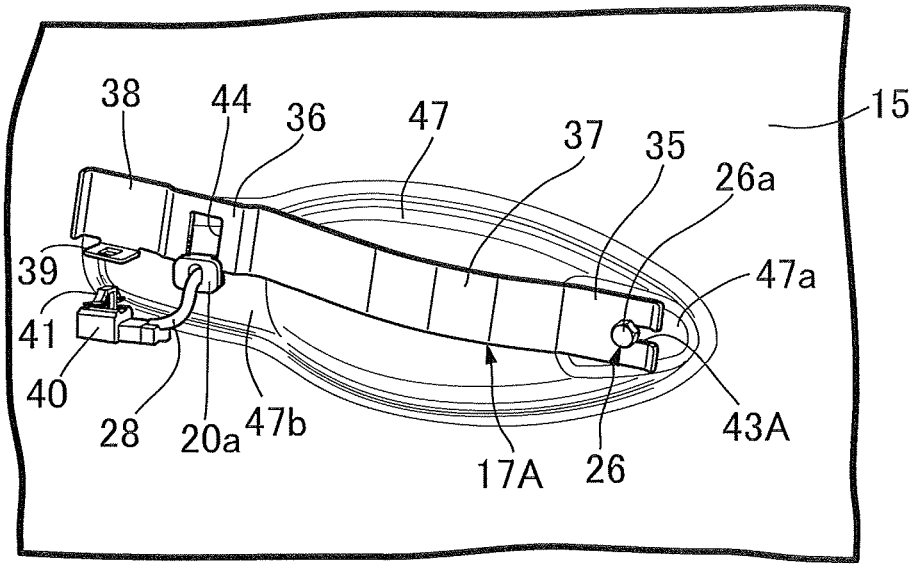
FIG. 7 is a perspective view, corresponding to FIG. 6, during the course of the base plate being engaged with the handle main body side. (first embodiment)
Figure 8:
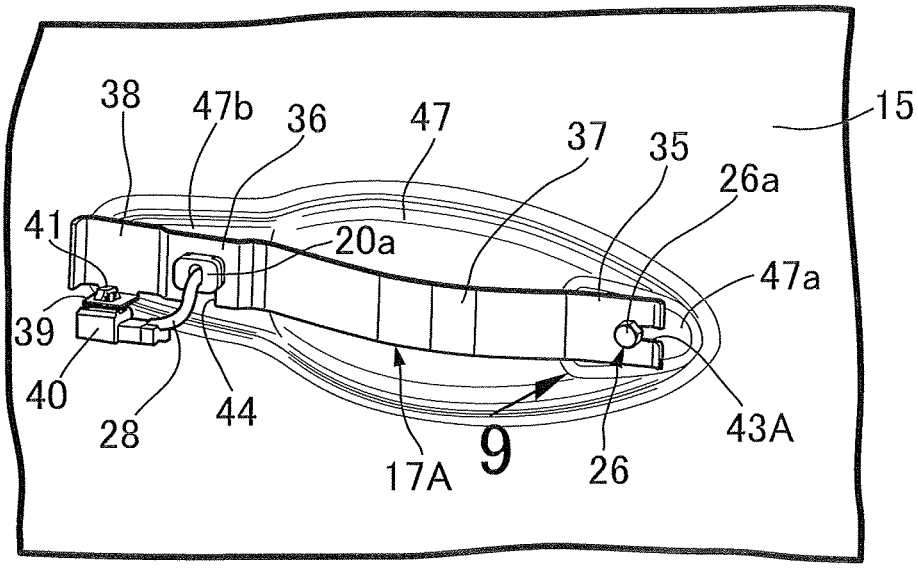
FIG. 8 is a perspective view, corresponding to FIG. 6, in a state in which the handle main body is fixed to the outer panel. (first embodiment)

In such a provisionally assembled state of the handle main body 16 onto the outer panel 15, as shown in FIG. 7, pivoting the base plate 17A having the first bolt 26 housed in the first engagement recess 43A around the axis of the first bolt 26 enables the second engagement portion 36 to be engaged with the latching grooves 32 of the penetrating portion 20*a*, as shown in FIG. 8, in a state in which the second engagement portion 36 is abutted against the flat portion 47*b* by fully engaging the second engagement portion 36 with the latching grooves 32 on the outer periphery of the penetrating portion 20*a* while housing the penetrating portion 20*a* in the second engagement recess 44 of the base plate 17A, rotating the first bolt 26 so as to clamp the first engagement portion 35 of the base plate 17A between the enlarged diameter head portion 26*a* and the flat portion 47*a* of the outer panel 15 enables the base plate 17A having the handle main body 16 engaged therewith to be fixed to the outer panel 15.

Figure 9:
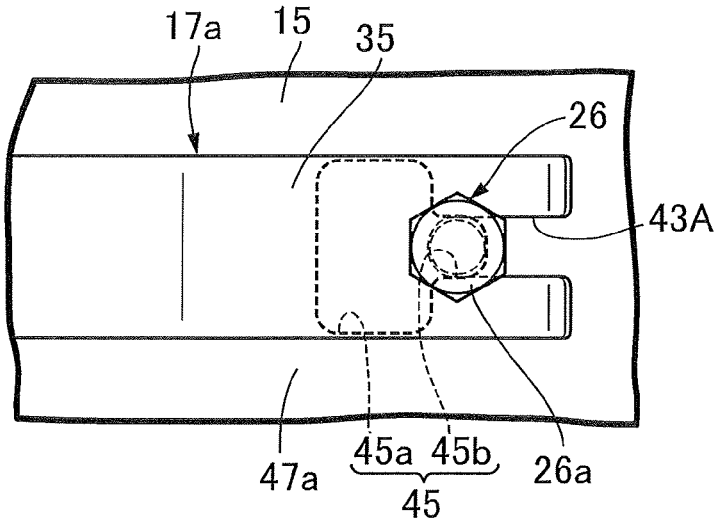
FIG. 9 is a view from arrow 9 in FIG. 8. (first embodiment)

In a state in which the first bolt 26 is inserted through and engaged with the latching hole 45 and the other end part of the base plate 17A is engaged with the latching grooves 32 of the penetrating portion 20*a*, as shown in FIG. 9, the direction of opening of the first engagement recess 43A is set so as to be a direction different from the direction of opening of the latching slit portion 45*b* toward the insertion hole portion 45*a*, and in this embodiment, the direction of opening of the first engagement recess 43A is forward along the passenger vehicle fore-and-aft direction whereas the direction of opening of the latching slit portion 45*b* toward the insertion hole portion 45*a* is rearward along the passenger vehicle fore-and-aft direction.

The operation of this first embodiment is now explained. The latching hole 45, which has inserted therethrough and engaged therewith the first bolt 26 having the enlarged diameter head portion 26*a* and being screwed into one end part in the longitudinal direction of the grip portion 16*a*, and the insertion hole 46, which has inserted therethrough the penetrating portion 20*a* provided on the other end part in the longitudinal direction of the grip portion 16*a* and penetrating into the outer panel 15, are provided in the outer panel 15 while enabling the handle main body 16 to be provisionally assembled onto the outer panel 15 such that the penetrating portion 20*a* is inserted through the insertion hole 46 while the first bolt 26 is engaged with the latching hole 45. The first engagement recess 43A, which houses the first bolt 26 while enabling one end part of the base plate 17A to be engaged with the enlarged diameter head portion 26*a*, and the second engagement recess 44, which houses the penetrating portion 20*a* while enabling the other end part of the base plate 17A to be engaged with the latching grooves 32 on the outer periphery of the penetrating portion 20*a* by pivoting the base plate 17A having the first bolt 26 housed in the first engagement recess 43A around the axis of the first bolt 26, are provided in the base plate 17A so as to open on the side edge of the base plate 17A.

Therefore, in a state in which the handle main body 16 is provisionally assembled onto the outer panel 15, pivoting the base plate 17A having the first bolt 26 housed in the first engagement recess 43A around the axis of the first bolt 26 enables the other end part of the base plate 17A to be engaged with the latching grooves 32 on the outer periphery of the penetrating portion 20*a* and, furthermore, tightening the first bolt 26 so as to make the enlarged diameter head portion 26*a* of the first bolt 26 abut against and engage with said one end part of the base plate 17A enables the handle main body 16 to be fixed to the outer panel 15. As a result, it is unnecessary to support the handle main body 16 by hand when assembling the handle main body 16 onto the outer panel 15, assembly of the handle main body 16 onto the vehicle door D becomes easy and, moreover, since there is only one position to be tightened, it is possible to reduce the number of components as well as the number of assembly steps. Furthermore, since engagement of the base plate 17A with the handle main body 16 is carried out by pivoting around the axis of the first bolt 26, and the base plate 17A only moves in parallel to the inner face of the outer panel 15, the pivoting operation of the base plate 17A on the outer panel 15 inner face side, where space is confined, is easy.

Moreover, the latching hole 45 provided in the outer panel 15 is formed from the insertion hole portion 45*a*, which enables the enlarged diameter head portion 26*a* to be inserted therethrough, and the latching slit portion 45*b*, which is connected to the insertion hole portion 45*a* while enabling the shaft portion 26*b* of the first bolt 26 to be inserted therethrough but making it impossible for the enlarged diameter head portion 26*a* to be inserted therethrough; in a state in which the first bolt 26 is inserted through and engaged with the latching hole 45 and the other end part of the base plate 17A is engaged with the latching grooves 32 of the penetrating portion 20*a*, since the direction of opening of the first engagement recess 43A is set so as to be a different direction from the direction of opening of the latching slit portion 45*b* toward the insertion hole portion 45*a*, when said one end part of the base plate 17A is engaged with the first bolt 26 in a state in which the first bolt 26 is inserted through and engaged with the latching hole 45 while inserting the shaft portion 26*b* of the first bolt 26 through the latching slit portion 45*b* of the latching hole 45, the shaft portion 26*b* of the first bolt 26 does not move from the latching slit portion 45*b* toward the insertion hole portion 45*a* side and, moreover, in a state in which said one end part of the base plate 17A is engaged with the first bolt 26 and said other end part of the base plate 17A is engaged with the latching grooves 32 on the outer periphery of the penetrating portion 20*a*, movement of the first bolt 26 becomes impossible, and assembly of the handle main body 16 onto the vehicle door D becomes easier.

Furthermore, since the penetrating portion 20*a* provided in the other end part of the handle main body 16 is provided with the through hole 29, via which the harness 28 connected to the board 22 disposed within the grip portion 16*a* is led out, it is possible to prevent the harness 28 from being caught between the handle main body 16 and the outer panel 15.

Moreover, since the second engagement portion 36 in the other end part of the base plate 17A is formed into a shape that exhibits resilience between the latching grooves 32 of the penetrating portion 20*a* and the outer panel 15, it is possible to prevent the base plate 17A having the handle main body 16 secured thereto from rattling.

Embodiment 2

Figure 10:
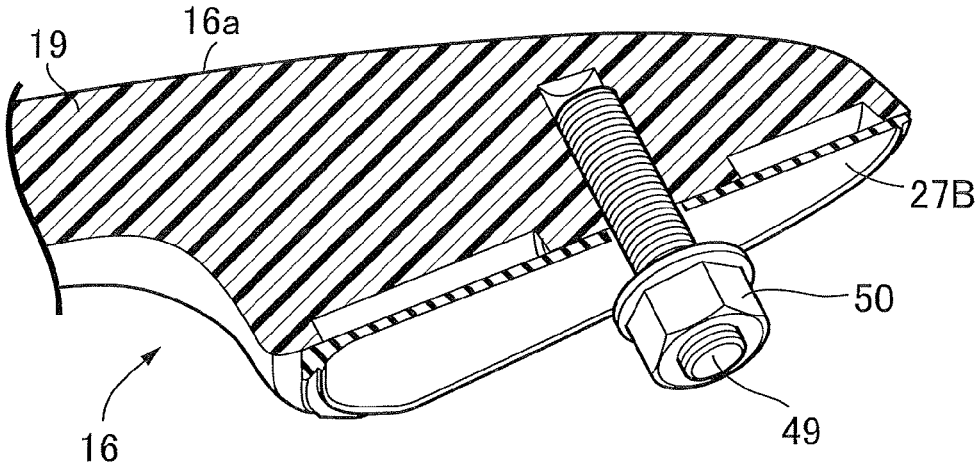
FIG. 10 is a perspective view, corresponding to FIG. 3, of a second embodiment. (second embodiment)

A second embodiment of the present invention is explained by reference to FIG. 10; portions corresponding to those of the first embodiment are denoted by the same reference numerals and symbols and only illustrated, a detailed explanation thereof being omitted.

The base of a second bolt 49 is implanted in one end part of a grip portion 16*a* of a handle main body 16, and a flat plate-shaped first seal member 27B having the second bolt 49 projecting from its middle section is fitted onto said one end part of the grip portion 16*a*.

A nut 50 is screwed around the tip side of the second bolt 49, the second bolt 49 can be inserted through and engaged with a latching hole 45 (see first embodiment) provided in an outer panel 15 while having the nut 50 screwed onto the tip side, and a first engagement recess 43A (see first embodiment) provided in a first engagement portion 35 of a base plate 17A can house the second bolt 49 so as to engage the nut 50 with the first engagement portion 35.

In accordance with this second embodiment, the same effects as those of the first embodiment above can be exhibited.

First and Second Modification Examples

Figure 11:
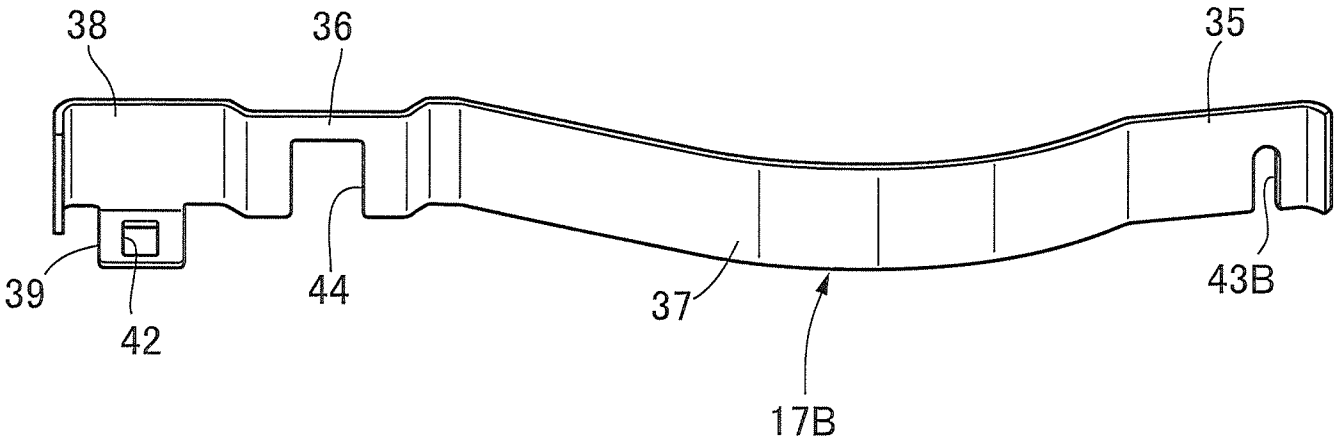
FIG. 11 is a perspective view showing a first modification example of the base plate. (first modification example)
Figure 12:
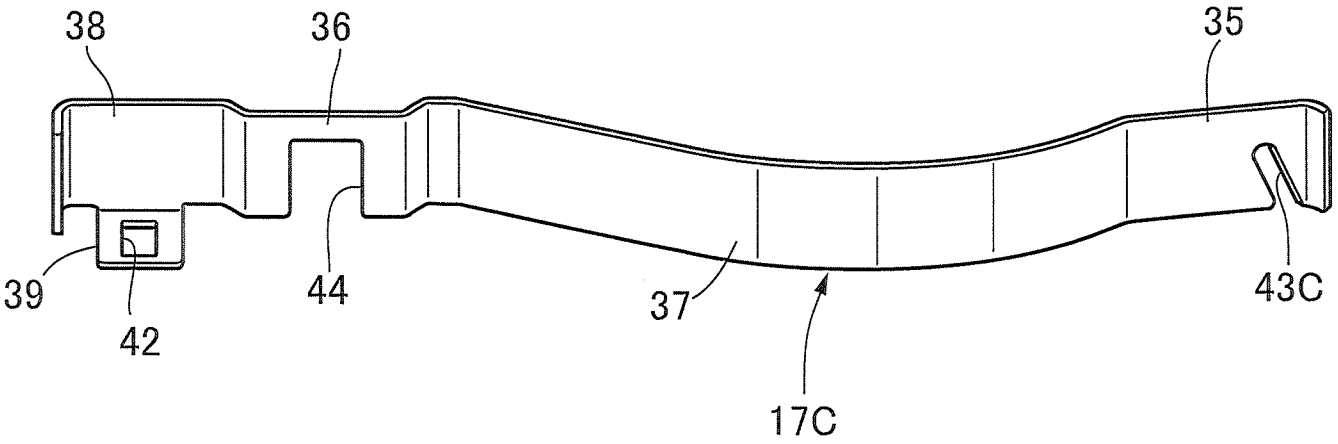
FIG. 12 is a perspective view showing a second modification example of the base plate. (second modification example)

In the above-mentioned embodiments, the front edge of the front end part of the first engagement portion 35 enabling the enlarged diameter head portion 26*a* of the first bolt 26 or the nut 50 screwed around the second bolt 49 to be engaged therewith is provided with the first engagement recess 43A opening forward in the passenger vehicle fore-and-aft direction, but the first engagement recess may open in a direction different from the direction of opening of the latching slit portion 45*b* toward the insertion hole portion 45*a* in a state in which the first bolt 26 or the second bolt 49 is inserted through and engaged with the latching hole 45 while enabling the base plate having the first bolt 26 or the second bolt 49 housed in the first engagement recess to be pivoted around the axis of the first bolt 26 or the second bolt 49, and the other end part of the base plate 17 is engaged with the latching grooves 32 of the penetrating portion 20*a*; as in a first modification example shown in FIG. 11, a first engagement recess 43B opening downward may be provided in a first engagement portion 35 in one end part of a base plate 17B, or alternatively as in a second modification example shown FIG. 12 a first engagement recess 43C inclined forward and downward and opening obliquely forward and downward may be provided in a first engagement portion 35 in one end part of a base plate 17C.

Modes for carrying out the present invention are explained above, but the present invention is not limited to the above-mentioned embodiments and may be modified in a variety of ways as long as the modifications do not depart from the spirit and scope thereof.

The invention claimed is:

1. An outside handle device for a vehicle door, the outside handle device comprising a handle main body having a grip portion including a first end part and a second end part, disposed outside an outer panel of a vehicle door, and a base plate having a first end part and a second end part, fixed to an inner face of the outer panel, the handle main body engaging the base plate, characterized in that the outer panel is provided with a latching hole and an insertion hole, the latching hole comprising an insertion hole portion and a latching slit portion having inserted therethrough and engaged therewith a first bolt or a second bolt, the first bolt having an enlarged diameter head portion and being screwed into one of the first end part and the second end part of the grip portion, the second bolt having a base thereof implanted in said one of the first end part and the second end part of the grip portion and having a nut screwed around a tip side thereof, and the insertion hole having inserted therethrough a penetrating portion that is provided on the other one of the first end part and the second end part of the grip portion, penetrates into the outer panel, and has a latching groove provided on the outer periphery of the penetrating portion, the handle main body being provisionally assembled onto the outer panel so that the penetrating portion is inserted through the insertion hole while engaging the first bolt or the second bolt with the latching hole, and the base plate is provided with a first engagement recess having an opening and a second engagement recess so as to open on a side edge of the base plate, the first engagement recess housing the first bolt or the second bolt so that one of the first end part and the second end part of the base plate engages with the enlarged diameter head portion or the nut, and the second engagement recess housing the penetrating portion so that the other one of the first end part and the second end part of the base plate engages with the latching groove of the penetrating portion by pivoting the base plate having the first bolt or the second bolt housed in the first engagement recess around an axis of the first bolt or the second bolt.

2. The outside handle device for a vehicle door according to claim 1, wherein the the latching slit portion of the latching hole has an opening toward the insertion hole portion, the insertion hole portion enabling the enlarged diameter head portion or the nut to be inserted therethrough, the latching slit portion being connected to the insertion hole portion while enabling a shaft portion of the first bolt or the second bolt to be inserted therethrough but making it impossible for the enlarged diameter head portion or the nut to be inserted therethrough, and in a state in which the latching hole has the first bolt or the second bolt inserted therethrough and engaged therewith and said other one of the first end part and the second end part of the base plate is engaged with the latching groove of the penetrating portion, the direction of opening of the first engagement recess is set so as to be a direction different from the direction of opening of the latching slit portion toward the insertion hole portion.

3. The outside handle device for a vehicle door according to claim 1, wherein the penetrating portion is provided with a through hole which receives a harness connected to an electrical component disposed within the grip portion.

4. The outside handle device for a vehicle door according to claim 1, wherein the base plate is formed into a shape that exhibits resilience between the latching groove of the penetrating portion and the outer panel.

5. The outside handle device for a vehicle door according to claim 2, wherein the penetrating portion is provided with a through hole which receives a harness connected to an electrical component disposed within the grip portion.

6. The outside handle device for a vehicle door according to claim 2, wherein the base plate is formed into a shape that exhibits resilience between the latching groove of the penetrating portion and the outer panel.

7. The outside handle device for a vehicle door according to claim 3, wherein the base plate is formed into a shape that exhibits resilience between the latching groove of the penetrating portion and the outer panel.

8. The outside handle device for a vehicle door according to claim 5, wherein the base plate is formed into a shape that exhibits resilience between the latching groove of the penetrating portion and the outer panel.

* * * * *